United States Patent [19]

Garrison

[11] 4,237,154

[45] Dec. 2, 1980

[54] IMPROVED GALVANIZING METHOD [AND APPARATUS]

[76] Inventor: William H. Garrison, P.O. Box 9256, Bellevue Station, Richmond, Va. 23227

[21] Appl. No.: 66,969

[22] Filed: Aug. 16, 1979

[51] Int. Cl.[3] ..... C23C 1/02

[52] U.S. Cl. ..... 427/241; 427/310; 427/329; 427/347; 427/398.3; 118/54

[58] Field of Search ..... 427/241, 310, 329, 347, 427/398.3; 118/52, 53, 54

[56] References Cited

U.S. PATENT DOCUMENTS

| | | | |
|---|---|---|---|
| 3,699,918 | 10/1972 | Garrison | 118/54 |
| 3,753,762 | 8/1973 | Garrison | 427/241 |

FOREIGN PATENT DOCUMENTS

| | | | |
|---|---|---|---|
| 7308104 | 10/1974 | France | 118/54 |

OTHER PUBLICATIONS

Gordet, The Galvanizing of Threaded Parts, Third International Conference on Hot Dip Galvanizing, 4th, 9th Jul. 1954, Zinc Development Assn., Oxford, England, Dec. 1954, pp. 125–134.

*Primary Examiner*—Ralph S. Kendall

*Attorney, Agent, or Firm*—Griffin, Branigan & Butler

[57] ABSTRACT

Articles of almost any imaginable configuration are given a uniform, complete coating over all surfaces by placing them in a spinnable perforate container or basket that is suspended from a reversible spinning assembly which is adapted to spin the perforate container and its articles in both directions during steps of the process of pre-coating, coating, quenching or air drying.

A new control system is also employed to provide rapid response in reversing directions of rotation of the perforated container or bringing it to a complete stop.

7 Claims, 4 Drawing Figures

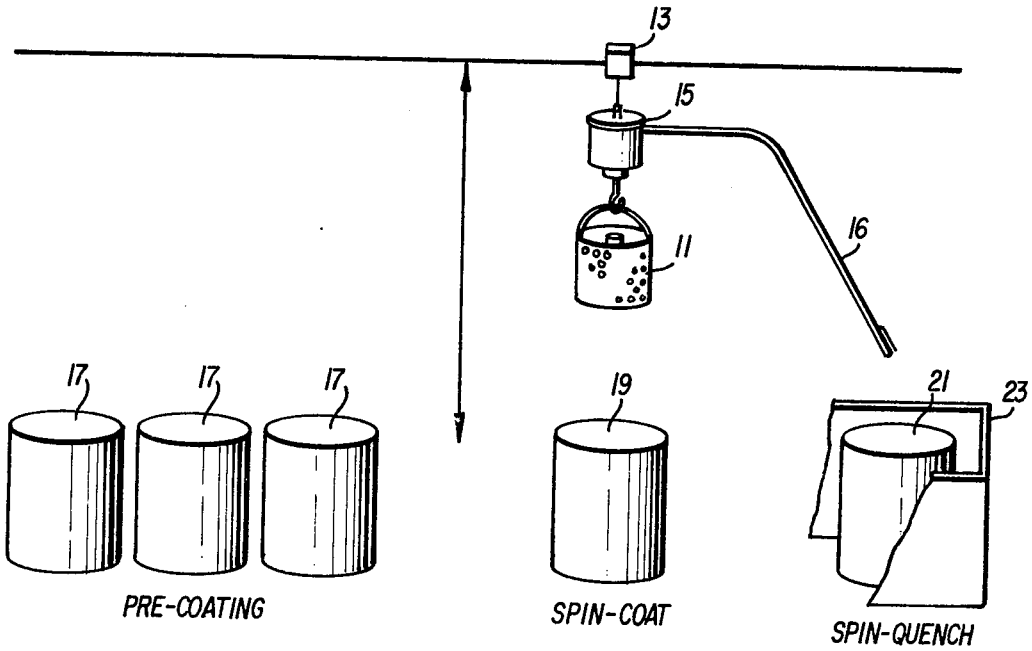
FIG. 1
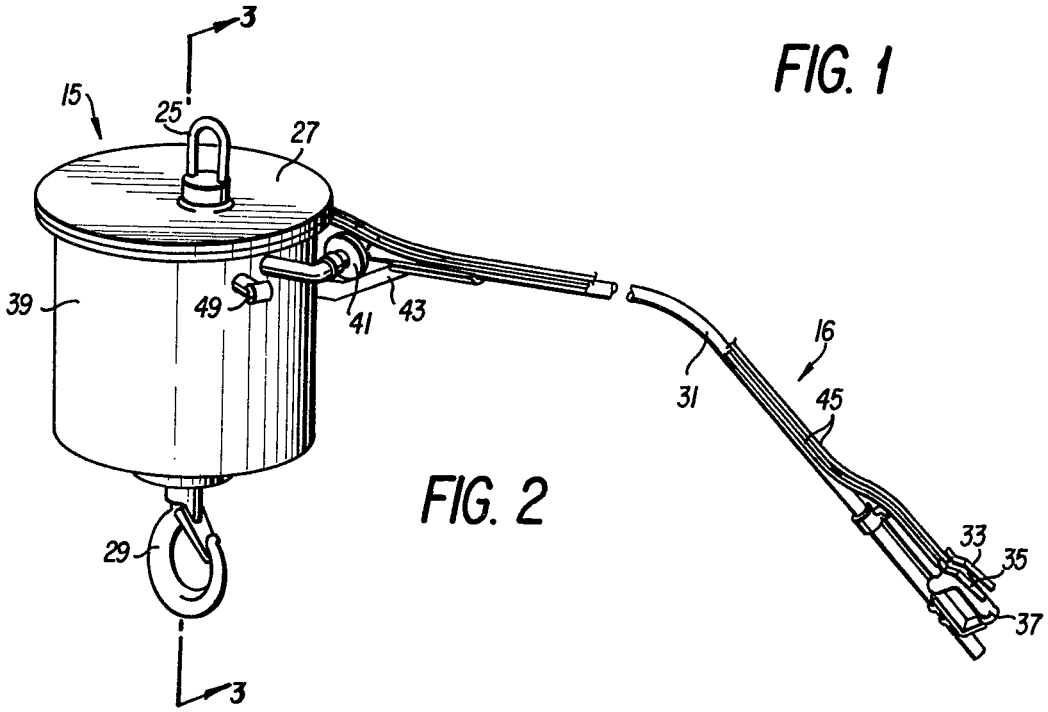
FIG. 2
FIG. 4
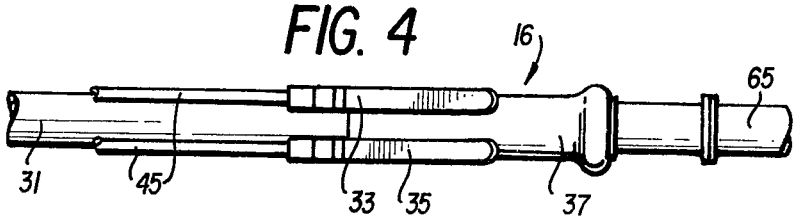

GALVANIZING METHOD [AND APPARATUS]

BACKGROUND

Current methods of galvanizing batches of articles include placing the articles in a spinnable, perforate container that is freely suspended above a work path comprised of a series of baths or tanks to be used during the process. The container and its contents are sequentially dipped in pre-coating tanks containing suitable pickling, rinsing and flux solutions and are then spun dry before being dunked into a molten zinc bath where they are galvanized. While the articles are suspended in the zinc bath, they are spun to more completely remove the flux from the articles being coated and more evenly coat their surfaces.

When the coating process is completed the perforate container and articles are lifted from the zinc bath and moved over a quench tank where they are spun to remove the excess molten zinc or spelter which drops into the quench tank for subsequent removal and use. While the perforate basket is still spinning it is lowered into the quench tank. When quenching has been completed, the spinning container is elevated from the tank and the articles spun dry. My U.S. Pat. Nos. 3,753,762 and 3,699,918 relate to the above-described technology.

The above-described method, however, has the problem that some of the concave or convex surfaces on the articles do not always receive a uniform coating over their reverse surfaces. In addition, in an effort to reduce reverse-surface defects, a container could not be loaded to its full capacity. Hence, it is an object of this invention to provide a method and apparatus for reduce reverse-surface defects while at the same time permitting increased loads.

SUMMARY

In accordance with broader aspects of this invention, articles of almost any imaginable configuration are given a uniform, complete coating over all surfaces by placing them in a spinnable perforate container or basket that is suspended from a reversible spinning assembly which is adapted to spin the perforate container and its articles in both directions during steps of the process of pre-coating, coating, quenching or air drying.

A new control system is also employed to provide rapid response in reversing directions of rotation of the perforated container or bringing it to a complete stop.

In addition, the structure of the reversible spinning assembly has been improved to provide for a heavier payload of articles to be coated.

BRIEF DESCRIPTION OF THE DRAWINGS

The foregoing and other objects, features, and advantages of the invention will be apparent from the following more particular description of preferred embodiments of the invention as is illustrated in the accompanying drawings, wherein reference characters refer to the same parts throughout the different views. The drawings are not necessarily drawn to scale. Instead, they are merely presented so as to illustrate the principles of the invention in a clear manner.

FIG. 1 is a schematic representation of the method and apparatus in which this invention is used;

FIG. 2 is a schematic illustration of this invention with its control means;

DETAILED DESCRIPTION

Figure 3:
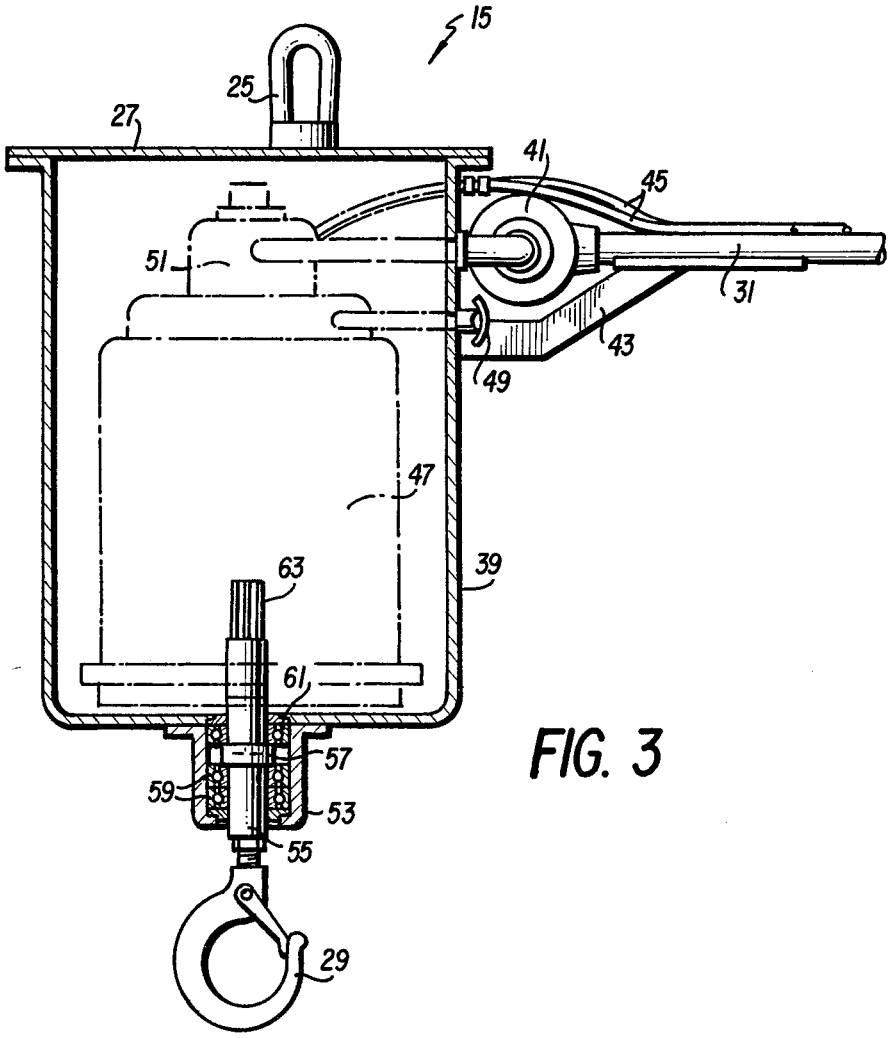
FIG. 3 is a cross-sectional representation of FIG. 2 taken along lines 3—3 thereof; and, FIG. 4 is a graphic illustration of the control means.

In accordance with the method in which the instant invention is used, the parts to be coated are placed in a perforate basket 11 which is freely supported above a work path by a travelling hoist 13 which provides both horizontal and vertical movement to the perforate basket 11 as indicated by the arrows in FIG. 1. Interposed between the perforate basket 11 and the travelling hoist 13 is a reversible spinning assembly 15 with its control handle 16.

In the initial steps, the perforate basket 11 containing the parts to be coated is lowered into tanks 17 containing a pre-coating solution or pickling, rinsing, and fluxing solutions. In this respect, the basket can be spun while it is dunked beneath the surface of each of the solutions.

After leaving the pre-coating tanks 17 the perforate basket 11 is spun until its contents are preferably dry and then it is moved above a spin-coat tank 19 where it is lowered into a molten zinc bath covered by a flux. As the perforate basket 11 is lowered into the molten zinc the flux is skimmed from the surface and the perforate basket 11 is spun first in one direction and stopped and then spun in the opposite direction by the reversible spinning assembly 15.

After the coating is completed in the spin-coat tank 19, the rotation of the perforate basket 11 is stopped and it is elevated from the spin-coat tank 19. The basket is then moved over the spin-quench tank 21 where it is lowered within a shield 23 which surrounds the spin-quench tank 21. It is then spun at a high rate of speed; stopped; and, then spun at a higher rate of speed in the reverse direction to remove the spelter from the parts within the perforate basket 11. While the perforate basket 11 is still spinning and the contents are still at a sufficiently high temperature that they do not stick together, the perforate basket 11 is lowered into the quenching solution for cooling and again intermittently stopped and spun in the opposite direction.

The perforate basket 11 is then elevated from the spin-quench tank 21 and spun first in one direction and then in the opposite direction to air dry the coated parts.

As can be seen in FIG. 2, the reversible spinning assembly 15 has a lifting bale 25 on its top cover 27 by which it is supported from the travelling hoist 13.

The reversible spinning assembly 15 has a hook 29 suspended from a lower housing to support the perforate basket 11.

The control handle 16 is comprised of a control arm 31 having a pair of pendents or valve-control levers 33 and 35 pivotably mounted to a throttle handle 37. The control arm 31 is secured to a motor housing 39 through a swivel arm assembly 41 and a support cradle 43. The forward pendent 33 and the reverse pendent 35 are connected individually by shuttle valve hoses 45 to the motor housing 39.

As can be seen in FIG. 3, an air motor 47 is mounted in the housing 39 and is vented to the outside atmosphere through an exhaust port 49. A shuttle valve 51 such as a "Modern Air Series 53 " Four-Way Spool Valve is connected to the main air line from the swivel arm assembly 41 and is connected by two lines to the air motor 47. In addition, the shuttle valve 51 is connected to the two shuttle valve hoses 45 and the exhaust port 49.

At the bottom of the motor housing 39 a hub housing 53 is secured to support a hub sleeve 55 into which the shaft of hook 29 is screwed. The hub sleeve 55 has a flange 57 at its midpoint which rides on two thrust bearings 59 which are supported by the hub housing 53. A third thrust bearing is positioned on top of the hub flange 57 between it and the bottom of the motor housing 39. A motor and hub spline shaft 63 connects the drive shaft of the air motor 47 to the hub sleeve 55.

As can be readily seen in FIG. 4, the right pendent 33 and the left pendent 35 of the control handle 16 are mounted on top of the throttle handle 37 which is secured to the control arm 31 and the main air line 65.

In operation, the reversible spinning assembly 15 supports the perforate basket 11 from its hook 29 which is threadibly secured to the hub sleeve 55. The hub sleeve 55 rides on the two thrust bearings 59 which are supported by the hub housing 53. The hub housing 53 is secured to the bottom of the motor housing 39 which is secured to the top cover plate 27. The entire reversible spinning assembly 15 is supported from the lifting bale 25 which is secured to the top cover plate 27. Thus the air motor 47 and its spline shaft 63 have no lifting stress placed on them.

This reversible spinning assembly 15 can support a perforate basket with approximately 3 tons of articles to be coated.

The direction of rotation of the air motor 47 is determined by an operator holding the control handle 16 and depressing either the forward pendent 33 or the reverse pendent 35 to exercise control over the four way shuttle valve 51. When the forward pendent 33 is depressed, the four way shuttle valve directs air to the forward rotation mode of the air motor 47. The air motor 47 is reversed when the forward pendent 33 is released and the reverse pendent 35 is depressed which causes the air motor 47 to come to an almost immediate stop and then to commence rotation in the reverse direction. If a complete stop is desired at that time, the reverse pendent 35 is released after the air motor has come to a stop and before it can commence rotation in the opposite direction.

The method of this invention results in a superior product that is evenly coated, bright, and free of water staining and flux clogging; and, is also substantially spurless. In addition, the bi-directional rotation of the parts to be coated provides an even coating on all sides of the part including both concave and convex surfaces.

While the invention has been particularly shown and described with reference to preferred embodiments thereof, it will be understood by those skilled in the art that various changes in form and detail may be made therein without departing from the spirit and scope of the invention. For example, the various pneumatic elements can be replaced by a suitable electric motor and switches or by a hydraulic motor, fluid lines and control valves.

The embodiments of the invention in which an exclusive property or privilege is claimed are defined as follows:

1. A method of spin-galvanizing articles comprising the steps of:

placing said articles in a perforate container;

suspending said container from a reversible fluid motor, said motor being suspended from a travelling crane;

transporting said reversible fluid motor and perforate container by said travelling crane above a work path where at selected locations along the work path said perforate container is lowered into and raised from pre-coating tanks while being spun first in one direction, stopped, and spun in a reverse direction about a vertical axis;

transporting said reversible fluid motor and said perforate container to a selected position along the work path where said perforate container is lowered into a molten zinc bath while spinning said perforate container and said articles first in one direction, stopping, and then spinning in a reverse direction about a vertical axis to coat articles on all sides and edges;

raising said perforate container from said zinc bath while continuing to spin said perforate container first in one direction, stopping, and then spinning in a reverse direction about said vertical axis to remove excess zinc therefrom before undesired zinc build-up occurs;

rapidly transporting said reversible fluid motor and said perforate container with the zinc-coated articles to a selected position along the work path where the container is continually spun first in one direction, stopped, and spun in a reverse direction as it is lowered into a quench tank while said articles are still at sufficiently high temperature that said articles do not stick together;

raising said perforate container from said quench tank while continuing to spin said perforate container and said zinc coated articles first in one direction, stopping and then spinning in a reverse direction about a vertical axis until dry to free said articles from water staining; and, transporting said reversible fluid motor and said perforate container with the zinc-coated articles above a work path to a selected location where said zinc coated articles are removed from said perforate container.

2. An improved spin-galvanizing apparatus for coating articles in a tank of molten metal by means of a portable, freely suspended centrifuge comprising:

article support means for supporting articles to be galvanized about a substantially vertical axis;

reversible motor having a rotatable shaft;

support means mounted between said reversible motor and said article support means for supporting the weight of said article support means and said reversible motor in a manner such that said reversible motor is free to rotate said article support means in either direction;

raising and lowering means mounted above said reversible motor said article support means and said support means and attached to said support means for selectively vertically raising and lowering said reversible motor said article support means and said support means;

movement means adapted to horizontally move said reversible motor said article support means and said support means from a position above said tank containing said molten metal to a position above said tank containing a quenching solution; and, control means for controlling said reversible motor for selectively braking the rotation thereof at any given time and controlling the direction of rotation thereof.

3. The apparatus of claim 2 wherein said reversible motor is a fluid motor.

4. The apparatus of claim 3 wherein said control means includes valve means to selectively direct fluid to said fluid motor for causing said fluid motor to selectively rotate in a forward or reverse direction.

5. The apparatus of claims 3 or 4 wherein said fluid motor is an air motor.

6. The apparatus of claim 4 wherein said valve means includes a shuttle valve.

7. The apparatus of claim 6 wherein said valve means further includes first and second pendents for selectively controlling air input to first and second input ports on said shuttle valve, one of said pendents being operative in combination with said shuttle valve to cause said fluid motor to rotate in said forward direction and the other of said pendents being operative in combination with said shuttle valve to direct said fluid to said fluid motor to rotate said fluid motor in said reverse direction.

* * * * *